US009228336B2

(12) United States Patent
Stauder

(10) Patent No.: US 9,228,336 B2
(45) Date of Patent: Jan. 5, 2016

(54) CONTAINMENT APPARATUS FOR TOILETS

(75) Inventor: Frank A. Stauder, London (CA)

(73) Assignee: Masco Canada Limited, London, Ontario (CA)

( * ) Notice: Subject to any disclaimer, the term of this patent is extended or adjusted under 35 U.S.C. 154(b) by 959 days.

(21) Appl. No.: 12/436,278

(22) Filed: May 6, 2009

(65) Prior Publication Data

US 2009/0320199 A1 Dec. 31, 2009

Related U.S. Application Data

(60) Provisional application No. 61/076,712, filed on Jun. 30, 2008.

(51) Int. Cl.
*E03D 11/00* (2006.01)

(52) U.S. Cl.
CPC ..... *E03D 11/00* (2013.01); *E03D 2201/40* (2013.01)

(58) Field of Classification Search
USPC ..... 4/300.3, 319, 420.3, 661, 223, 420, 4/255.04
See application file for complete search history.

(56) References Cited

U.S. PATENT DOCUMENTS

| | | | | | |
|---|---|---|---|---|---|
| 237,036 | A | * | 1/1881 | Meye | 4/425 |
| 2,164,320 | A | | 7/1939 | Groeniger | |
| 2,172,506 | A | | 9/1939 | Gerger | |
| 2,685,094 | A | | 8/1954 | MacAillo | |
| 3,224,013 | A | * | 12/1965 | Tubbs | 4/425 |
| 3,534,415 | A | | 10/1970 | Huffman | |
| 4,075,718 | A | | 2/1978 | Hargraves | |
| 4,183,105 | A | * | 1/1980 | Womack | 4/300 |
| 4,433,441 | A | | 2/1984 | Schroeder | |
| 4,709,426 | A | * | 12/1987 | Godwin, Jr. | 4/300.3 |
| 4,996,726 | A | | 3/1991 | Schrock et al. | |
| 5,031,259 | A | | 7/1991 | Baiera et al. | |
| 6,041,451 | A | | 3/2000 | Francis | |
| 6,332,229 | B1 | * | 12/2001 | O'Malley et al. | 4/438 |
| 6,519,786 | B1 | | 2/2003 | Francis | |
| 6,622,315 | B1 | * | 9/2003 | Feygin et al. | 4/223 |
| 6,675,398 | B1 | | 1/2004 | Antunez | |
| 7,316,038 | B2 | * | 1/2008 | Egeresi | 4/420.4 |
| 2006/0097189 | A1 | | 5/2006 | Lim | |
| 2006/0191064 | A1 | | 8/2006 | Tan | |

* cited by examiner

*Primary Examiner* — Janie Christiansen

(74) *Attorney, Agent, or Firm* — Carlson, Gaskey & Olds, PC

(57) ABSTRACT

A spray system, which reduces contamination caused by toilet flushing, is activated during a flush cycle to contain waste matter and prevent escape thereof from the bowl. The system is mounted above the level of water in a toilet and includes an aperture that creates a spray and is fluid communication with the flush valve of the toilet. Accordingly, each time the flush valve is activated, a portion of the water provided to the toilet is directed to the aperture to create a spray to minimize escaping effluent.

12 Claims, 1 Drawing Sheet

CONTAINMENT APPARATUS FOR TOILETS

This application claims priority to U.S. Provisional Application No. 61/076,712 which was filed on Jun. 30, 2008.

BACKGROUND OF THE INVENTION

When toilets are flushed they churn water and that which is contained in the water into the atmosphere near the toilets. Bacteria and viruses from droplets produced by flushing a toilet remain airborne long enough to settle on surfaces throughout a bathroom. These microbes may also float in the air for two hours after each flush.

SUMMARY OF THE PRESENT INVENTION

The present invention reduces contamination caused by toilet flushing by using a spray system that is activated during a flush cycle to contain waste matter and prevent escape thereof from the bowl.

According to an embodiment of the invention, the apparatus is mounted above the water level of the toilet and includes an aperture that creates a spray. The aperture is in fluid communication with the flush valve of the toilet. Accordingly, each time the flush valve is activated, a portion of the water provided to the toilet is directed to the aperture.

According to another embodiment of the invention, an interior edge of a member placed on a toilet seat has a series of apertures that create a fluid spray barrier across the top opening of the toilet bowl. This spray barrier is intended to reduce the amount of contaminants that are splashed or churned up into the air during flushing of the toilet.

In a further embodiment, a secondary series of apertures along the member are sized to create a high velocity jet of water directed into the bowl to break up solid contaminants in the toilet.

Other objects, features and advantages of the invention will be apparent from the following detailed description taken in connection with the accompanying drawings.

BRIEF DESCRIPTION OF THE DRAWINGS

The present invention will be more fully understood by reference to the following detailed description of a preferred embodiment when read in conjunction with the accompanying drawing, in which like reference characters refer to like parts throughout the views and in which.

DETAILED DESCRIPTION OF THE PREFERRED EMBODIMENT OF THE PRESENT INVENTION

Figure 1:
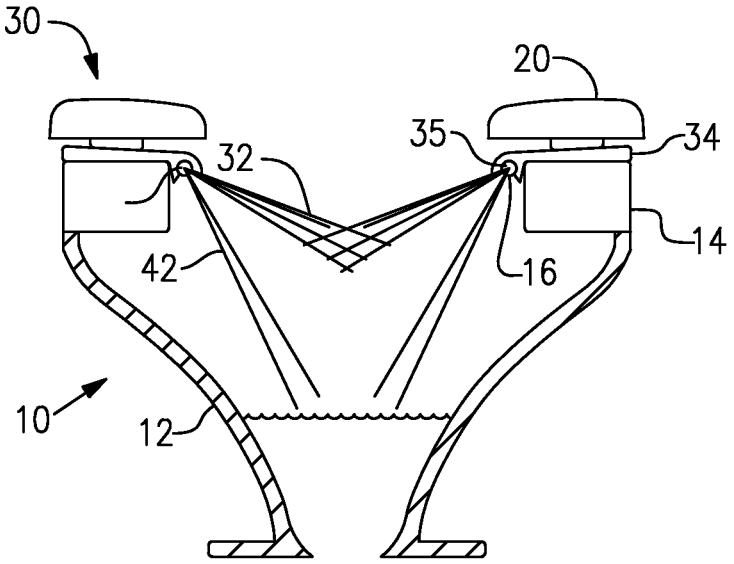
FIG. 1 is a front cross-sectional view of a toilet bowl and toilet seat incorporating the present invention.
Figure 2:
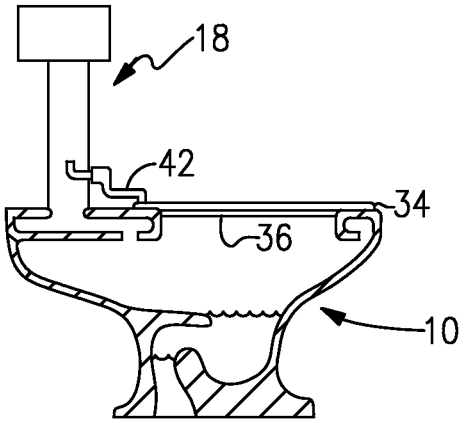
FIG. 2 is a side cross-sectional view of a toilet incorporating the present invention.
Figure 3:
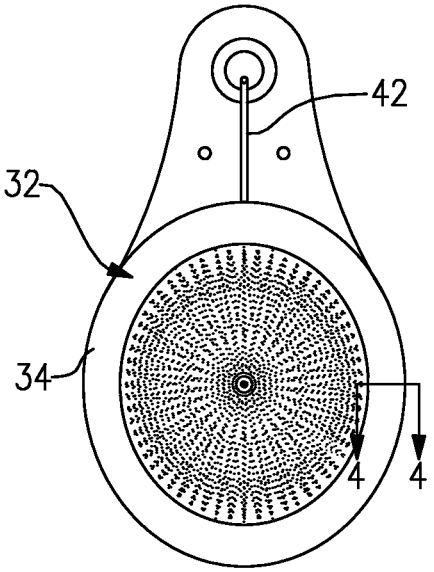
FIG. 3 is a top plan view of a toilet incorporating the present invention.
Figure 4:
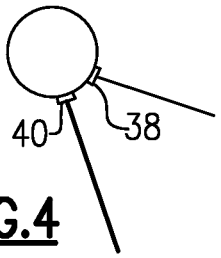
FIG. 4 is a partial cross-sectional view of the outlet nozzles taken along the line 4-4 of FIG. 3 of the present invention.

Referring generally to FIGS. 1 through 4, there is shown a toilet 10 generally used to collect and dispose of waste matter from individual users. A typical toilet 10 will include a toilet bowl 12 having an upper rim 14 and an outlet passageway 16 to direct waste water to the sewage system. A flushing device 18 (see FIG. 2) is associated with the toilet 10 to deliver flush water to the toilet bowl 12. A typical flushing device 18, which may be obtained from Masco Canada Inc. of London, Ontario, Canada, may include a flush valve housed within a toilet tank that, upon activation, directs flush water through the rim 14 and into the bowl 12 to flush waste water into a sewage system. Also typically associated with a toilet 10 is a selectively deployable toilet seat 20 that, in its lowered position, sits on the rim 14 of the toilet bowl 12.

The present invention is a waste containment system for the upper portion of the toilet bowl 12. The system creates a spray barrier 32 across the upper opening of the toilet bowl 12 to minimize splash-up and containment clouds from exiting the bowl 12 during a flush cycle. The system 30 includes a member 34 (see FIG. 3) that is preferably flexible and adaptable to sit on top of the rim 14 of the toilet bowl 12. The member 34 has a portion 35 (see FIG. 1) that extends past the rim 14 to protrude over an interior of the bowl 12 and includes a fluid passageway or spray tube 36 that is molded into the member 34.

The spray tube 36 includes a first series of apertures 38 spaced along its length that act as orifices or nozzles for creating a fine spray of water. In alternative embodiments, the spray tube 36 includes a second series of apertures 40 for creating a secondary spray pattern that breaks up solid waste to maximize the flushing function.

In order to supply water to the spray tube 36 of the member 34, a supply line 42 is fluidly connected to the flushing mechanism 18. Upon activation of the flushing device 18, water under pressure is directed through the supply line 42 to the spray tube 36 and out at least the first series of apertures 38 to create a spray barrier 32 (see FIG. 3.) across a top of the toilet bowl 12. The water may flow from the spray tube 36 across water disposed in the bowl from one side to the other. The water may flow from the spray tube 36 across water disposed in the bowl from one side to the other. The size of the nozzles 38 will determine the nature of the spray barrier 32. Similarly, nozzles 40 are sized and aimed to concentrate a higher-force stream of water 42 on an area of the bowl 12 in which solid waste tends to concentrate (See FIG.1). The higher force stream of water tends to break up solid waste thereby minimizing a probability of clogging and maximizing the amount of waste removed during flushing. By maximizing the amount of waste removed, the probability of required second flushings and the amount of water used is minimized.

The present invention is intended to be adapted to a variety of toilet configurations and easily installable on existing toilets 10. The system 30 is unintrusive as it is intended to sit on the rim 14 and captured against the rim 14 by the toilet seat 20. Upon each flush, the spray barrier 32 is created across the top of the bowl 12 reducing the splash up or mist up of contaminants up and over the top of the toilet bowl 12.

During operation, the spray pattern (see FIGS. 1 and 3) of the misting jets cover an area related to the area from which effluent from the toilet may be churned up thereby minimizing the amount of escaped effluent that may carry undesirable bacteria and viruses thereby creating a safer environment for users. While the mist barrier covers the bowl, the high pressure spray helps break up the solid waste to maximize the flushing function.

The foregoing detailed description has been given for clearness of understanding only and no unnecessary limitations should be understood therefrom as some modifications will be obvious to those skilled in the art. One of ordinary skill in the art will recognize that in accordance with the teachings of this invention, the spray from one or more apertures may create an effective barrier to effluent escape. Though the present system is shown in use with a commercial-type flush mechanism, one of ordinary skill in the art recognizes that other applications for the invention provided herein are readily available.

What it claimed is:

1. A system for creating a spray of fluid across water disposed in a toilet bowl in which waste resides, said system comprises:

A fluid passageway mounted on a rim of said toilet bowl, said fluid passageway including a first plurality of apertures that direct a fluid spray barrier across said water disposed in said toilet bowl, said fluid spray barrier minimizing an escape of waste from said toilet bowl during flushing, said first fluid spray escaping from said first plurality of apertures at a given pressure and, a second plurality of apertures in said fluid passageway, said second plurality of apertures directing a higher pressure stream of fluid than said given pressure into an area of said toilet bowl in which solid waste concentrates to break up said solid waste in said toilet bowl during flushing.

2. The system of claim 1 wherein said first plurality of apertures further comprises a nozzle for creating a mist.

3. The system of claim 1 wherein said second plurality of apertures further includes a second spray pattern for directing a stream of fluid to break up any solid waste in said toilet bowl during flushing.

4. The system of claim 1 wherein said second plurality of apertures is aimed to direct said higher pressure stream into water disposed in said bowl.

5. The system of claim 1 wherein said second plurality of apertures is aimed to direct said higher pressure stream into a low point in said bowl.

6. A method for flushing a toilet said method comprising:

providing fluid passageway mounted on a rim of said toilet bowl, said fluid passageway including a first plurality of apertures and a second plurality of apertures;

flushing said toilet;

directing a fluids spray barrier at a given pressure from said first plurality of apertures across said water disposed in said toilet bowl, said fluid spray barrier minimizing an escape of waste from said toilet bowl while flushing, and directing a higher pressure stream of fluid into said water than said given pressure from said second plurality of apertures into water in said toilet bowl, said higher pressure stream breaking up said solid waste in said toilet bowl while flushing.

7. The method of claim 6 further comprising:

directing fluid from a flush valve to said fluid passageway and to flush the toilet.

8. The method of claim 7 wherein fluid is directed from said flush valve simultaneously to said fluid passageway and to flush the toilet.

9. A system for creating a spray of fluid across water disposed in a toilet bowl in which waste resides, said system comprises:

a member sitting on top of a rim of said toilet bowl;

a portion of said member extending past said rim protruding over an interior of said toilet bowl, said portion including a fluid passageway including;

a first plurality of apertures that direct a fluid spray barrier across said water disposed in said toilet bowl, said fluid spray barrier minimizing an escape of waste from said toilet bowl during flushing, said first fluid spray escaping from said first plurality of apertures at a given pressure and a second plurality of apertures in said fluid passageway, said second plurality of apertures directing a higher pressure stream of fluid than said given pressure into an area of said toilet bowl in which solid waste concentrates to break up said solid waste in said toilet bowl during flushing.

10. The system of claim 9 wherein said second plurality of apertures further includes a second spray pattern for directing a stream of fluid to break up any solid waste in said toilet bowl during flushing.

11. The system of claim 9 wherein said second plurality of apertures is aimed to direct said higher pressure stream into water disposed in said bowl.

12. The system of claim 9 wherein said second plurality of apertures is aimed to direct said higher pressure stream into a low point in said bowl.

* * * * *